US005356134A

United States Patent [19]

DeMatteo

[11] Patent Number: 5,356,134

[45] Date of Patent: Oct. 18, 1994

[54] FAIRWAY DISTANCE MARKER

[75] Inventor: Dante E. DeMatteo, Port St. Lucie, Fla.

[73] Assignee: Dande Plastics, Inc., Dunellen, N.J.

[21] Appl. No.: 174,131

[22] Filed: Dec. 28, 1993

[51] Int. Cl.[5] ..... A63B 57/00

[52] U.S. Cl. ..... 273/32 R; 40/608; 116/209; 273/32 A

[58] Field of Search ..... 273/32 A, 32 H, 32 R, 273/176 A; 40/598, 608; 116/209

[56] References Cited

U.S. PATENT DOCUMENTS

| | | | |
|---|---|---|---|
| 3,371,647 | 3/1968 | Shopbell | 116/209 |
| 3,599,981 | 8/1971 | Zausmer | 273/176 A |
| 3,709,188 | 1/1973 | Coupar | 116/209 X |
| 4,108,439 | 8/1978 | McGuire | 273/176 R |
| 4,489,669 | 12/1984 | Carman | 273/32 R X |
| 4,862,823 | 9/1989 | Hughes | 116/209 |
| 5,072,940 | 12/1991 | Bailey | 273/176 A |
| 5,114,149 | 5/1992 | Bailey | 273/176 A |
| 5,205,236 | 4/1993 | Hughes | 116/209 X |
| 5,219,171 | 6/1993 | Kirby et al. | 273/32 H |
| 5,230,297 | 7/1993 | Lakatos | 273/176 A X |
| 5,236,166 | 8/1993 | Darling | 273/32 R X |
| 5,263,262 | 11/1993 | Steere | 273/32 R X |

FOREIGN PATENT DOCUMENTS 2202155 9/1988 United Kingdom .

*Primary Examiner*—William H. Grieb
*Attorney, Agent, or Firm*—Watov & Kipnes

[57] ABSTRACT

A distance marker comprised of a base plate including channels that face each other along opposite sides of the top of said base plate, a web extending from the bottom of said base plate, teeth formed in said web, and barbs at the ends of said teeth.

19 Claims, 2 Drawing Sheets

FAIRWAY DISTANCE MARKER

FIELD OF THE INVENTION

The field of the present invention relates generally to distance markers, and more particularly to markers for a golf course fairway indicating a distance from the markers to the green, respectively.

BACKGROUND OF THE INVENTION

In playing golf it is important for a player to determine the distance between his or her ball and the center of the green. It has been suggested that this can be more easily done if distance markers are placed along an edge of the fairway at given intervals such as every 25, 50, 150, 200, 225, 250 yards from the green. This distance marker indicating the distance between it and the center of the green is helpful for correct club selection. Each distance marker has its distance from the green, indicated thereon e.g. 100 yds, 200 yds. etc. By looking at the distance marker nearest his ball a player can make a fairly accurate judgement of distance in order to determine correct club selection.

For a distance marker to be practical, it must be impervious to sunlight (UV and/or IR), weather and chemicals such as fertilizer or weed killers, capable of staying in place and resisting damage when run over with fairway maintenance machines or golf carts and easy to see while not providing a golfing hazard.

Various fairway yard markers of the prior art are briefly described below.

Two U.S. Patents of Bailey, namely U.S. Pat. Nos. 5,072,940, and 5,114,149, teach the use of golf course fairway or distance markers that generally comprise a flexible marker strip that is secured within the ground via various securement means. An upper portion of the marker strip projects vertically from the ground for showing the associated distance to a hole or from the tee. The marker strips are flexible enough to bend out of the way if struck by a golf cart or lawn mower.

Kirby et al., U.S. Pat. No. 5,219,171, teaches a collapsible golf course fairway distance marker that includes a conically shaped upper portion that protrudes slightly upward from the surface of the ground and includes a plurality of strips upon which numerals can be imprinted for displaying desired distances. The individual strips or leaves are connected at their innermost ends to a spring loaded piston-like mechanism that is contained within an anchor housing portion of the marker which is buried or embedded below ground. If a golf cart or mower passes over the marker, the leaves retract downward, and out of the way, as a result of the spring bias mechanism. After the heavy object has moved over the marker, the spring biasing pushes the leaves back up to restore the normal configuration of the marker.

Lakatos, U.S. Pat. No. 5,230,297, entitled "Golf Distance Marker", teaches the use of a rectangular base member secured below ground to which a flat thin sign is inserted within a slot in the base member, for providing yardage markings.

UK Patent Application GB2202155A, discloses the use of golf course distance markers that have conically shaped top marker portions which protrude slightly above the ground that are secured to the ground via a cylindrically shaped base member.

In the U.S. Pat. No. 3,599,981 to Zausmer, a fairway distance marker is shown having a rectangular base plate with raised numerals indicating yards on its top and pins projecting from its bottom that are to be inserted in the ground. There is a pin at each corner and one at the middle of two opposing sides. Cone shaped barbs are mounted on the ends of the pins so as to prevent the base plates from being easily pulled up. A frame having an opening through which the yard number can be seen is snapped onto the top of the base plate.

BRIEF SUMMARY OF THE INVENTION

In the fairway distance marker of this invention, a base plate is provided having means on its top to which a distance indicator sheet may be removably attached, and coplanar aligned teeth extending from the bottom. Arrow-like barbs are formed at the tops of the teeth, and, preferably, a web joins the bases of adjacent teeth. In its preferred form, the means to which the distance indicator sheet is removably attached is comprised of means forming grooves along opposing parallel edges of the top of the base plate into which opposed edges of a sheet can be slid. In order to tightly hold the sheet in position, apertures or depressions are formed in the base plate into which dimples in the sheet can lock. The surfaces of the distance marker other than those at the ends are perpendicular to a plane that is perpendicular to the parallel edges of the base plate so that the marker can be formed by an extrusion process.

BRIEF DESCRIPTION OF THE DRAWINGS

Various embodiments of the present invention are described in detail below with reference to the drawings, which corresponding components are identified by the same reference designation, wherein.

DETAILED DESCRIPTION OF THE INVENTION

Figure 1A:
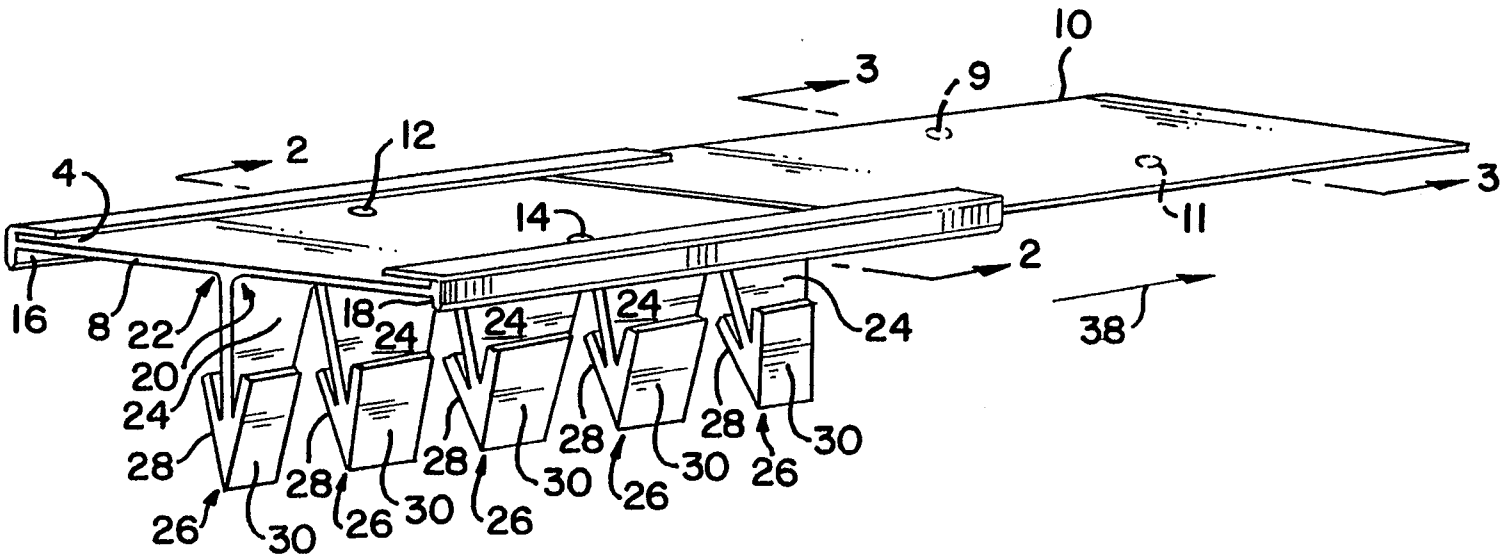
FIG. 1A is an isometric view of a fairway distance marker of one embodiment of the invention.

In FIG. 1A, means are provided for forming channels 2 and 4 along parallel sides of the top 6 of a base plate 8. The open sides of the channels 2 and 4 face each other. A distance indicator in the form of a sheet of material 10 on which a given number is formed, herein being one hundred yards, is shown as being poised for insertion into the channels 2 and 4 so as to rest on the top 6 of the base plate 8. When the distance indicator 10 is thrust into the final position, dimples on its underside represented by dashed line circles 9 and 11, drop or lock into holes 12 and 14 in the base plate 8. In its preferred form, ridges 16 and 18 extend downwardly from the sides of the base plate 8.

Figure 1B:
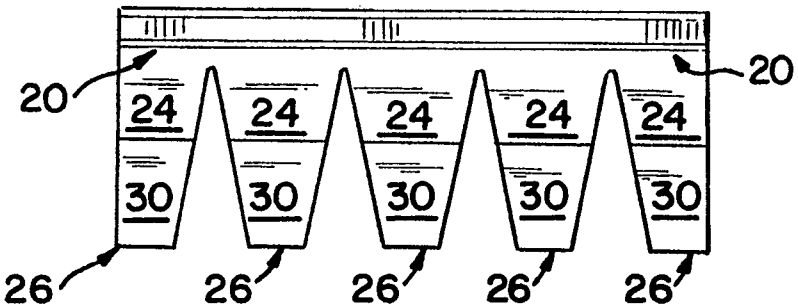
FIG. 1B is a front elevational view of the fairway distance marker of FIG. 1A.

As shown in FIGS. 1A and 1B, a web 20 extends perpendicularly from the center line of the bottom 22 of the base plate 8, and teeth 24 are formed in the lower edge of the web 20. In this particular embodiment, the teeth 24 are trapezoidal. In use, the teeth 24 are thrust into the fairway or ground until the ridges 16 and 18 come in contact with the ground. In order to prevent the teeth 24 from being easily pulled from the ground, barbs 26 are formed at their ends. In this particular embodiment, the barbs 26 are formed by projections 28 and 30 from opposite sides of the ends of the teeth 24. Only one of the projections 28 and 30 could be used if desired, although two are preferred.

Figure 2:
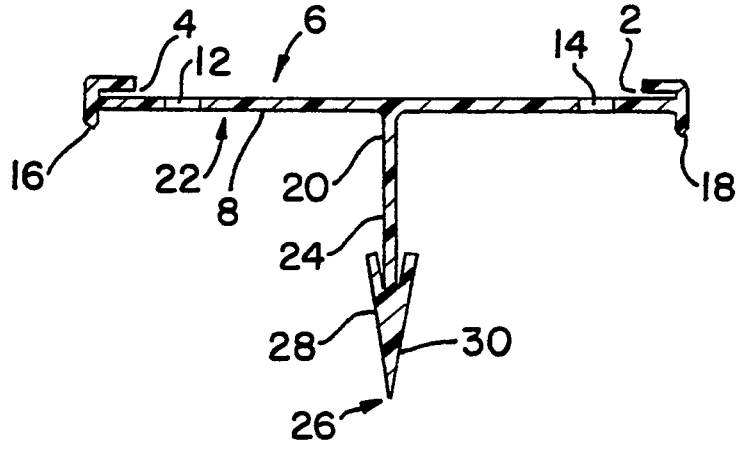
FIG. 2 is a cross section taken along 2—2 of FIG. 1A.
Figure 3:
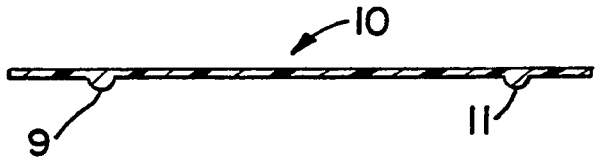
FIG. 3 is a cross section taken along 3—3 of FIG. 1A.

Reference is now made to the cross section, FIG. 2, of the distance marker taken along 2—2 of FIG. 1A, and to FIG. 3 which is a cross section of the distance indicator sheet 10 taken along 3—3 of FIG. 1A. When the indicator sheet 10 is fully inserted into the grooves 2 and 4, the dimples 9 and 11 are locked into the holes 12 and 14, respectively, so as to hold the indicator sheet 10 in position, as previously indicated. Since the distance indicator sheet 10 is thinner than the height of the grooves 2 and 4, it can be easily removed by simply pulling it upward to snap it out of grooves 2 and 4, and release dimples 9 and 11 from holes 12 and 14, respectively.

Figure 4:
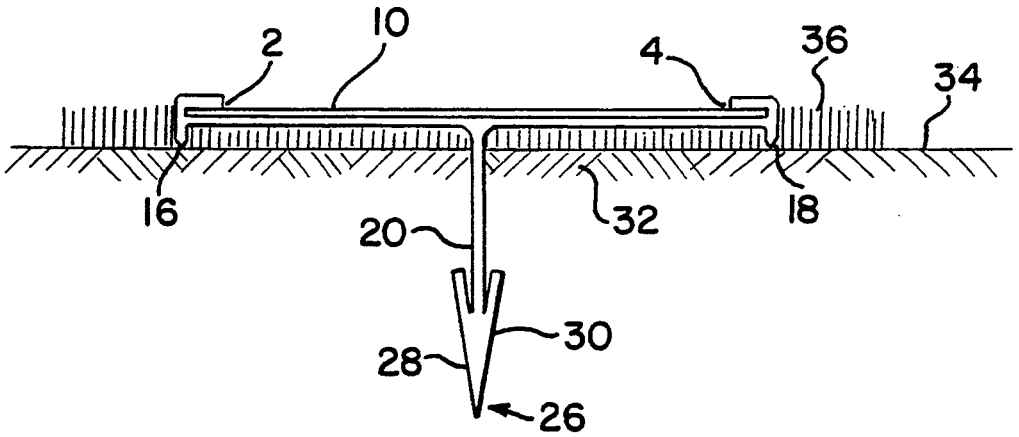
FIG. 4 is an end view of the fairway distance marker of FIG. 1A with a distance indication sheet mounted therein.

FIG. 4 shows an end view of a preferred form of the distance marker of this invention when mounted for use along a fairway. The surface of the ground or soil 32 is indicated at 34. When properly installed, the grass is cut very short, as indicated at 36, within an area that is at least as large as that covered by the marker, and the barbs 26 are forced into the soil 32. Preferably, the soil 32 is sufficiently moist from rain or watering to be relatively soft. In its final position, the ridges 16 and 18 contact the ground level 34 as shown. It can be seen that the barbs 26 formed by the projections 28 and 30 at the ends of the teeth 24 will prevent the distance marker from being inadvertently pulled up. Alternatively, the distance marker may be implanted by forming a groove in the soil, inserting the barbs 26 into the groove and packing the soil over the teeth and against the web 20.

The distance indicator sheet 10 can be made of any suitable material, but the rest of the marker is preferably made of plastic such as rigid PVC with UV stabilizers, because it will last indefinitely and is sufficiently elastic to recover its shape after a machine has rolled over it.

In order to make it unnecessary to read the number, the distance indicator sheet 10 can be color coded in accordance with accepted practice as indicated below:

100 yards—red background, white numbers
150 yards—white background, black numbers
200 yards—blue background, white numbers
all others—yellow background, orange numbers All the rest of the marker is preferably green so as to blend in with the grass and not interfere with the color coding.

An advantage of this invention is its low cost of manufacture owing to the fact that the surfaces of the base plate 8, the means forming the grooves 2 and 4, the ridges 16 and 18, the web 20, the teeth 24 and the projection 28 and 30 are such that they can be formed by an extrusion process in which material is forced through an opening having the shape of the cross section at 2—2 of FIG. 1A. A suitable material is rigid polyvinylchloride (PVC).

From an inspection of FIG. 1A it can be seen that all surfaces that are perpendicular to a cross section along 2—2 extend in the direction of an arrow 38. Such surfaces are defined as being ones in which parallel lines can be drawn. As previously noted, the yardage indicator sheets 10 could easily be changed if desired. The V shaped openings between the teeth 24 can be formed by stamping or cutting.

Although various embodiments of the invention have been shown and described above, they are not meant to be limiting. Those of skill in the art may recognize various modifications to these embodiments, which modifications are meant to be covered by the spirit and scope of the appended claims.

What is claimed is:

1. A distance marker comprising:
a base plate having parallel sides, opposing ends, a top and a bottom;
means forming channels having open sides that face each other along the parallel sides of the top;
a web perpendicular to the bottom of said base plate extending in a direction parallel to said sides between said opposing ends;
teeth formed in the part of said web that is remote from the bottom of said base plate; and
barbs at ends of said teeth that are remote from said base plate.

2. A distance marker as set forth in claim 1, further including:
said channels, base plate, web and barbs being shaped so that they are formable by an extrusion process from a plastic material.

3. A distance marker as set forth in claim 2, wherein said plastic material is rigid PVC.

4. A distance marker as set forth in claim 1, further comprising:
ridges extending from the bottom of said base plate along said parallel sides.

5. A distance marker as set forth in claim 1, further comprising:
a distance indicator sheet that is insertable via its side edge portions in said channels, for retention on the top of said base plate.

6. A distance marker as set forth in claim 5, further comprising:
at least one hole formed in said base plate; and
at least one dimple on the side of said distance indicator sheet adjacent said base plate that is in registration with said hole, for locking said distance indicator sheet on said base plate, when said distance indicator sheet is fully inserted into said channels.

7. A distance marker as set forth in claim 1, wherein said barbs are V-shaped with the bottom of the "V" providing a bottommost portion of said distance marker.

8. A distance marker as set forth in claim 1, wherein said barbs are configured as arrowheads.

9. A distance marker comprising:
a base plate having a top, bottom and parallel sides;
channels having their open sides facing each other formed on said top along said parallel sides;
a web extending from the bottom of said base plate,
teeth formed in said web;
barbs formed at the ends of said teeth; and
all surfaces of said marker that are visible in a cross section perpendicular to said sides extending in a direction that is parallel to said sides, for facilitating the formation of said marker by an extrusion process, from a plastic material.

10. The distance marker of claim 9, wherein said plastic material consists of PVC.

11. The distance marker of claim 9, wherein said barbs are in the form of arrowheads.

12. The distance marker of claim 9, wherein said barbs are V-shaped, with the bottom of each V-shaped barb being farthest from the bottom of said base plate.

13. A fairway distance marker comprising:

a base plate having parallel sides, opposing ends, a top and a bottom;

means forming channels having open sides that face each other along the parallel sides of the top;

a distance indicator sheet that is removably insertable via its side edge portions thereof into said channels, for retention on said base plate;

a web perpendicular to the bottom of said base plate extending in a direction parallel to said sides between said opposing ends;

teeth formed in the part of said web that is remote from the bottom of said base plate; and barbs at ends of said teeth that are remote from said base plate.

14. A distance marker as set forth in claim 13, further including:

said channels, base plate, web and barbs being shaped so that they are formable by an extrusion process from a plastic material.

15. A distance marker as set forth in claim 14, wherein said plastic material is rigid UV stablized PVC.

16. A distance marker as set forth in claim 13, further comprising:

ridges extending from the bottom of said base plate along said parallel sides.

17. A distance marker as set forth in claim 13, further comprising:

at least one hole formed in said base plate; and at least one dimple on the side of said distance indicator sheet adjacent said base plate that is in registration with said hole, when said distance indicator sheet is fully inserted into said channels.

18. A distance marker as set forth in claim 13, wherein said barbs are V-shaped with the bottom of the "V" providing a bottommost portion of said distance marker.

19. A distance marker as set forth in claim 13, wherein said barbs are configured as arrowheads.

* * * * *